United States Patent [19]

Sinn et al.

[11] 4,219,512

[45] Aug. 26, 1980

[54] MANUFACTURE OF FIBRIDS FROM POLYMERS

[75] Inventors: Richard Sinn, Heidelberg; Otto Nagel, Neustadt; Bruno Sander, Ludwigshafen; Eckhard Bonitz, Frankenthal; Kurt Scherling, Hemsbach; Hans Dieter Zettler, Gruenstadt; Dieter Stoehr, Mutterstadt; Heinz Berbner, Moerlenbach, all of Fed. Rep. of Germany

[73] Assignee: BASF Aktiengesellschaft, Fed. Rep. of Germany

[21] Appl. No.: 839,661

[22] Filed: Oct. 5, 1977

[30] Foreign Application Priority Data

Oct. 14, 1976 [DE] Fed. Rep. of Germany ..... 2646332

[51] Int. Cl.[2] ..... B22D 23/08

[52] U.S. Cl. ..... 264/11; 162/157 R; 264/14; 264/140

[58] Field of Search ..... 264/12–14, 264/11, 127, 140; 162/157 R

[56] References Cited

U.S. PATENT DOCUMENTS

| | | | |
|---|---|---|---|
| 2,999,788 | 9/1961 | Morgan | 264/184 |
| 3,529,936 | 9/1970 | Muller-Rid et al. | 264/14 |
| 4,013,751 | 3/1977 | Davis et al. | 264/140 |
| 4,091,058 | 5/1978 | Sander et al. | 264/184 |

*Primary Examiner*—Jay H. Woo
*Attorney, Agent, or Firm*—Keil & Witherspoon

[57] ABSTRACT

Manufacture of fibrids from polymers or copolymers containing fluorine in a fluid precipitation medium under the action of shearing forces.

6 Claims, 3 Drawing Figures

MANUFACTURE OF FIBRIDS FROM POLYMERS

The present invention relates to a process for the manufacture of fibrids from fluorine-containing polymers.

According to the process disclosed in German Published Application No. DAS 1,469,120, suspensions of fibrids are obtained when polymers are precipitated from a solution by dispersing the solution in a precipitation medium under the action of shearing forces. The shearing action is produced either by means of a stirrer (Waring mixer) or by means of a fluid undergoing turbulent flow.

German Laid-Open Application No. DOS 2,252,758 discloses a process for producing fibrids from polymers of high molecular weight. In this process it is necessary to feed a hot solution of the polymer to a rapidly rotating centrifugal spinning device (a hammer mill). Using this method, the polymer solution undergoes orientation in a first process step, whilst in a second process step the dissolved polymer is precipitated. However, the product obtained consists merely of a fibrous mass swollen with solvent, from which mass the individual fibrids still have to be liberated. This is achieved by a plurality of successive expensive process steps, eg. squeezing out the solvent, cutting the fibrous mass and performing several milling operations.

Our co-pending Application Ser. No. 674,149 relates to a process for the manufacture of fibrids by introducing a solution of a polymer into a fluid precipitation medium in a field of shearing forces, in which process solutions of polymers or copolymers of styrene, vinyl chloride or vinylidene chloride in methyl ethyl ketone, tetrahydrofuran or 1,4-dioxane are used and are introduced, at room temperature, into a fluid precipitation medium with simultaneous exposure to shearing forces, the mean energy density in the fibrid-forming zone of the field of shearing forces being at least 5 Watt. sec/cm$^3$.

We have found that this process gives particularly advantageous fibrids, exhibiting substantial improvements in respect of their chemical resistance, heat resistance and mechanical properties, if, instead of polymers or copolymers of styrene, vinyl chloride or vinylidene chloride, fluorine-containing polymers and/or copolymers which are soluble in the said solvents, at least at elevated temperatures, are used.

A suitable polymer soluble in the said solvents is polytrifluorochloroethylene, whilst suitable copolymers are those of ethylene with trifluorochloroethylene and of tetrafluoroethylene with vinylidene fluoride. These are commercial products and are manufactured by conventional processes, for example in accordance with U.S. Pat. No. 2,643,988.

In manufacturing the fibrids, the instructions of our co-pending Application Ser. No. 674,149 are followed. For convenience, these will be described once again below. The only difference is that the fluorine-containing polymers or copolymers are dissolved in the solvents under pressure and/or at elevated temperatures; being essentially crystalline materials, they are less readily soluble in, for example, tetrahydrofuran. Thereafter, however, the further treatment is carried out as described in the above co-pending Application.

Accordingly, the present invention relates to fibrids of fluorine-containing polymers and/or copolymers, which fibrids have a length of from 0.5 to 30 mm, a thickness of from 0.5 to 10 $\mu$m, a specific surface area of from 10 to 70 m$^2$.g$^{-1}$ and a Schopper-Riegler freeness of from 10° to 50° SR.

For the purposes of the present invention, fibrids are fibrous, synthetic polymer particles which morphologically, in size and shape, and in their properties resemble cellulose fibers.

Introducing the solution of the polymer into a fluid precipitation medium means mixing the solution with a large excess of the precipitation medium at room temperature. The polymers dissolved in a solvent at room temperature should be insoluble in the precipitation medium, but the solvent used should preferably be miscible in all proportions with the precipitation medium.

Suitable solvents are tetrahydrofuran, methyl ethyl ketone and 1,4- dioxane, the first-mentioned being preferred. Dimethylformamide may also be used. Compared to other, less suitable, solvents, these solvents are distinguished by their high solvent power, at room temperature, even for the fluorine-containing polymers in question, by their good miscibility with water and by their low boiling point. With water, they form an azeotrope which contains a high proportion of organic solvent. This is of importance for economical recovery of the solvent. For the manufacture of fibrids from the polymer solutions in accordance with the invention, the concentration of the polymers in the solution can be from 0.5 to 30, preferably from 10 to 25, percent by weight.

Water has proved a particularly suitable fluid precipitation medium. However, the process can also be carried out with other precipitation media such as, for example, ethylene glycol or alkanols of 1 to 4 carbon atoms. It is essential that the dissolved polymer should be insoluble in the precipitation medium, whilst the solvent used is miscible with the said medium.

Preferred polymers, which in the present case are substantially crystalline, are the specifically mentioned fluorine-containing polymers and copolymers.

The term fibrid-forming zone means the zone of a generator of a field of shearing forces, in which the polymer solution and the fluid precipitation medium meet and in which a mean energy density of at least 5 Watt . sec/cm$^3$ prevails.

The volume of the fibrid-forming zone depends on the flow velocity of the precipitation medium which is being mixed with the polymer solution. Since the fibrids are formed within a period of from $1.10^{-2}$ to $1\text{-}10^{-4}$ second, the length of the fibrid-forming zone at flow velocities of from 5 to 50 m/sec is from 0.1 to 50 cm, preferably from 0.1 to 5 cm.

The generators used to produce a field of shearing forces are devices which do so mechanically, by means of rotating tools. Commercial equipment used for the dispersion and homogenization of, for example, polymer dispersions are suitable for this purpose. In the case of batchwise operation, high-speed dispersing machinery or shearing force field generators of the Ultra-Turrax type can be used.

Preferred forms of apparatus for generating the shearing forces are illustrated in the drawings, wherein.

Figure 1:
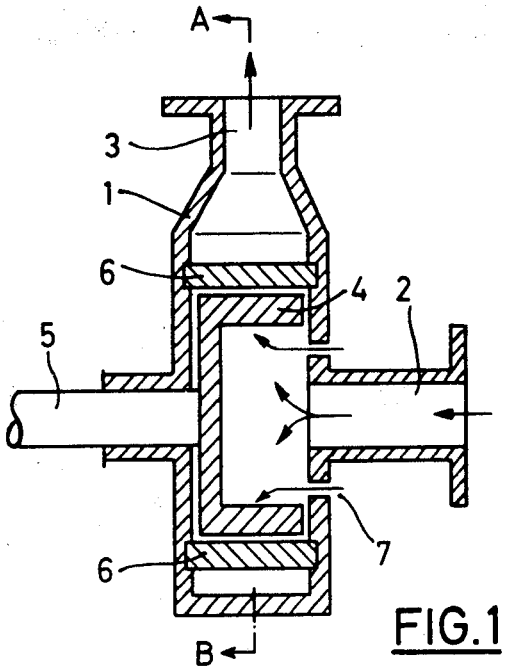
FIG. 1 is a diametric section of a mechanical, rotary shear generator.
Figure 3:
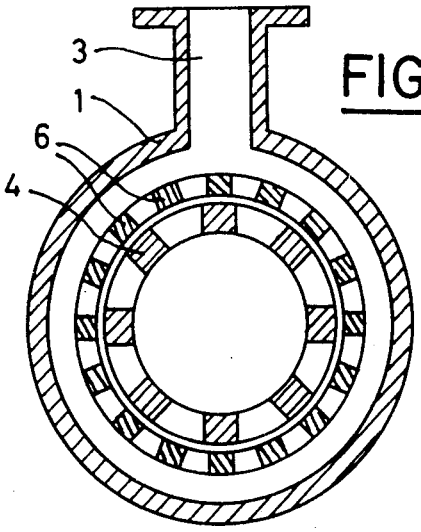
FIG. 3 is a section of the shear generator of FIG. 1 taken on section plane A-B.

Continuous operation is possible with the following equipment (FIG. 1): a housing (1) with an inlet nozzle (2) and outlet nozzle (3) contains a rotor (4) which is driven by a shaft (5). This rotor (4) causes the fluid precipitation medium which is present in the housing, and is fed in continuously through the inlet nozzle (2), to execute a rotary motion. In doing so, the kinetic energy of the rotor is transmitted to the fluid precipitation medium. The accelerated fluid precipitation medium is braked in an annular braking zone (6). This converts part of the kinetic energy into heat. The braking zone is formed by an annular stator which possesses sharp-edged orifices and baffle surfaces.

To manufacture fibrids, the polymer solution is introduced by means of a metering pump, through a tube (7) of internal diameter 4 mm, into the fluid precipitation medium, the outlet orifice of the tube being at the point at which the fluid precipitation medium undergoes its maximum acceleration. A fibrid suspension is discharged continuously from the outlet nozzle (3). The mean energy density can be from 20 to 80 Watt . sec/cm$^3$.

If the solution of the polymer is extruded through one or more jets, and is thoroughly mixed—simultaneously, if desired—with the fluid precipitation medium at a flow velocity of at least 5 m/sec in a field of shearing forces, fibrids are again obtained. The mean energy density in the fibrid-forming zone is from 5 to 30 Watt . sec/cm$^3$.

According to a particular embodiment, the thorough mixing of the flowing media takes place in an impulse exchange zone concentric with, and upstream from, the two-material nozzle. The device is disclosed in German Laid-Open Application No. DOS 2,208,921.

Figure 2:
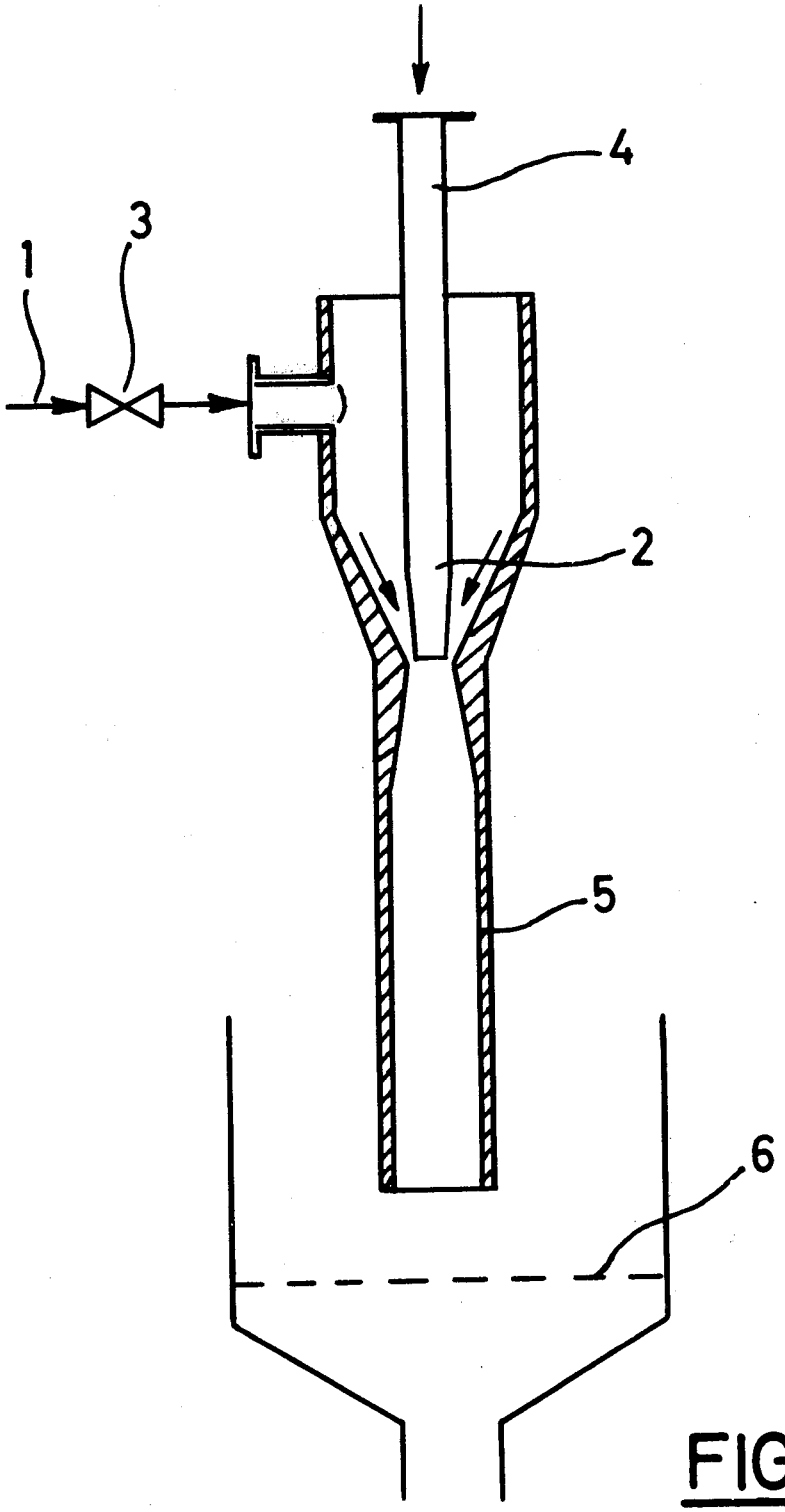
FIG. 2 is a diametric section of a hydraulic shear generator.

A further embodiment uses the injector principle. This device is described in more detail in FIG. 2.

In all the embodiments of the process, stable, discrete fibrids are obtained directly. They can be separated from the fluid precipitation medium and from the greater part of the organic solvent by filtering or centrifuging. The remaining solvent is removed by washing with water on the filter or in the centrifuge. The organic solvents employed can be recovered by distillation and be recycled to the process.

The fibrids obtained have a water content of from 80 to 92 percent by weight and can be employed, in this form, for wet uses.

For special uses, the fibrids can be dried at elevated temperatures of up to 60° C. A drying method which employs heating and transport gases at a high flow velocity has proved particularly suitable. This method defelts any felted fibrids.

The fibrids manufactured by the process of the invention have a length of from 0.5 to 30 mm and a thickness of from 0.5 to 10 μm. As compared to staple fibers obtainable from synthetic fibers, they have, on the one hand, a relatively large specific surface area (from 10 to 70 m$^2$/g) and on the other hand are capable of forming a sheet when the fibrids are deposited, from aqueous suspension, on a wire.

Aqueous suspensions of the fibrids manufactured according to the invention are prepared by, for example, introducing the fibrids, whilst stirring, into water which may or may not contain a dispersing agent in an amount of from 0.1 to 1.0 percent by weight, based on the dry weight of the fibrids. The fiber stock obtained is then treated for from 5 to 15 minutes with a high-speed propeller stirrer. The stock consistency is in general from 0.5 to 10% and preferably from 1 to 5%.

Examples of suitable dispersing agents are surfactants built up from hydrophilic and hydrophobic segments, polyvinyl alcohols and starch.

After appropriate further dilution with water, the aqueous suspensions of the fibrids can be converted to paper-like sheets on a paper machine or wet-laid nonwoven machine. In contrast, synthetic fibrids, for example of polyethylenes, obtained in accordance with the prior art can only be converted to paper-like sheets when, preferably, mixed with cellulose, and when using substantial amounts of dispersing assistants.

The fibrids according to the invention can, however, also be mixed with cellulose fibers in any proportion, and the mixture can be converted to self-supporting coherent webs on a paper machine.

The degree of fibrillation of the fibrids obtained was ascertained by determining the freeness by the Schopper-Riegler method (Korn-Burgstaller, Handbuch der Werkstoffprüfung, 2nd edition 1953, Volume 4, Papier und Zellstoffprüfung, pages 388 et seq., Springer-Verlag). To carry out this determination, the fibrids have to be converted to an aqueous suspension having a constant stock consistency (2 g/l at 20° C.). The amount of water retained by the suspended fibrids under specific conditions is determined. The amount of water taken up (°Schopper-Riegler or °SR) is the greater, the higher is the fibrillation of the fibrids. The Schopper-Riegler value of unbeaten sulfite cellulose is from 12° to 15° SR. The Schopper-Riegler values of the fibrids according to the present invention are, for example, from 15° to 50° SR.

To produce coherent, self-supporting webs on the paper machine it is necessary that the sheet should have a sufficiently high initial wet strength. A standard sheet (2.4 g) produced from the fibrids must have an initial wet strength of at least 80 g at a water content of 83 percent by weight. Standard sheets produced on a Rapid-Köthen sheet former, from the fibrids manufactured according to the invention, in the present case have an initial wet strength of from 50 to 200 g.

The initial wet strength is determined by means of the test instrument developed by W. Brecht and H. Fiebinger (Karl Frank, Taschenbuch der Papierprüfung, 3rd enlarged edition, Eduard Roether Verlag, Darmstadt, 1958, page 59). By inserting a frame, test strips of size 30×95 mm are produced on a sheet former from the fibrids to be tested. The thickness of the test strips (weight per unit area) is determined by the amount of stock used. The test instrument is then used to measure the load in g at which the test strip tears.

The mean energy density E in the fibrid-forming zone of the field of shearing forces was calculated as follows:

$$E = m \cdot v^2/2 [W \cdot sec]$$

m = weight (in kg) of the precipitation medium and of the polymer solution, which flows through the fibrid-forming zone in one second.

v = mean flow velocity (in m/sec) of the combined fluids.

The specific surface area was determined by the BET nitrogen adsorption method (S. Brunauer, T. H. Emmett and E. Teller, J. Amer. Chem. Soc., 60 (1938), 309).

The particular advantage of the process according to the invention is that discrete stable fibrids which are virtually free from organic solvents and which have substantially greater chemical stability and heat stability than conventional fibrids, are obtained directly.

In the Examples which follow, parts and percentages are by weight.

EXAMPLE 1

A copolymer of trifluorochloroethylene and vinylidene fluoride in the molar ratio of 25:1, having a density of 2.1 g/cm$^3$, is dissolved in tetrahydrofuran in a stirred autoclave at 105° C. under a pressure of 10 bars. The pressure is applied by means of a nitrogen blanket. A 3% strength homogeneous solution is prepared and is then fed to the apparatus shown in FIG. 2. The polymer solution is extruded through an annular die with a gap width of 0.6 mm. The water drive jet (4) has a diameter of 3 mm and a velocity of 32 m/s and is at 25° C. As a result, the polymer solution is cooled abruptly at the locus of fibrid formation. The fibrids produced are thoroughly mixed with the water in which they have been precipitated and are fed onto a belt filter. There, they are washed once more, suction-drained and removed as a web.

The fibrids have a fine structure, and a specific surface area of 16 m$^2$/g. They can be used to produce sheets. The following measurements were obtained in accordance with papermaking standards:

| | | |
|---|---|---|
| freeness | 13.0 | °SR |
| dewatering time | 3.1 | s |
| initial wet strength of a standard sheet | 70 | g |

EXAMPLE 2

The procedure described in Example 1 is followed except that a 5% strength polymer solution is prepared.

The specific surface area of the fibrids is 22 m$^2$/g.

The following measurements were obtained in accordance with papermaking standards:

| | | |
|---|---|---|
| freeness | 10 | °SR |
| dewatering time | 2.85 | s |
| initial wet strength | 52 | g |

EXAMPLE 3

The procedure described in Example 1 is followed except that a polytrifluorochloroethylene is used as the polymer. The density is 2.12 g/cm$^3$ and the zero strength time according to ASTM D 1430/56 T is 500 seconds. The polymer solution is of 3% strength. The fibrids have a fine structure, with a length of from 2 to 6 mm and a thickness of from 5 to 15 μm.

The following measurements were obtained in accordance with papermaking standards:

| | | |
|---|---|---|
| freeness | 13 | °SR |
| dewatering time | 3 | s |
| initial wet strength | 54 | g |

EXAMPLE 4

The procedure described in Example 1 is followed except that a copolymer of tetrafluoroethylene and vinylidene fluoride is used as the polymer. The density of the polymer is 1.76 g/cm$^3$. An 8% strength solution is prepared at 40° C. Dimethylformamide is used as the solvent.

The following were measured:

| | | |
|---|---|---|
| freeness | 13.5 | °SR |
| dewatering time | 3.3 | s |
| initial wet strength | 99 | g |

EXAMPLE 5

The procedure described in Example 1 is followed except that a copolymer of ethylene and chlorotrifluoroethylene having a density of 1.68 g/cm$^3$ is used as the polymer. A homogeneous 12% strength solution is prepared at 170° C. Tetrahydrofuran is used as the solvent. The following were measured:

| | | |
|---|---|---|
| freeness | 11 | °SR |
| dewatering time | 2.8 | s |
| initial wet strength | 86 | g |

EXAMPLE 6

The procedure described in Example 4 is followed except that the fibrids are produced from a 3% strength homogeneous solution. The following were measured:

| | | |
|---|---|---|
| freeness | 14.3 | °SR |
| dewatering time | 5.5 | s |
| initial wet strength | 160 | g |

If, instead of dimethylformamide, methyl ethyl ketone is used as the solvent, the following measurements are obtained:

| | | |
|---|---|---|
| freeness | 11 | °SR |
| dewatering time | 3 | s |
| initial wet strength | 63 | g. |

We claim:

1. A process for the manufacture of fibrids which comprises introducing a solution of a crystalline polymer or copolymer containing a fluorine-substituted monomer at room temperature into a fluid precipitation medium under the action of shearing forces, the solvent for said polymer or copolymer being methyl ethyl ketone, tetrahydrofuran, 1,4-dioxane or dimethyl formamide and the concentration of said polymer or copolymer in said solution being in the range of 0.5 to 30% by weight, said shearing forces being generated mechanically by rotating elements to provide a mean energy density in the fibrid-forming zone in the field of shearing forces in the range of 20 to 80 Watt . sec/cm$^3$.

2. The process as claimed in claim 1, wherein said fluid precipitation medium is water or ethylene glycol.

3. A process for the manufacture of fibrids which comprises introducing a solution of a crystalline polymer or copolymer containing a fluorine-substituted monomer at room temperature into a fluid precipitation medium under the action of shearing forces, the solvent for said polymer or copolymer being methyl ethyl ketone, tetrahydrofuran, 1,4-dioxane or dimethylformamide and the concentration of said polymer or copolymer in said solution being in the range of 0.5 to 30% by weight, said shearing forces being generated by forcing said solution through one or more nozzles at a flow rate of at least 5 m/sec into said fluid precipitation medium and thereby thoroughly mixing the solution of said polymer or said copolymer with said fluid precipitation medium, and generating by said forcing of said solution into said fluid precipitation medium a mean energy density in the fibrid-forming zone of the field of shearing forces in the range of 5 to 30 Watt . sec/cm$^3$.

4. A process as claimed in claim 3, wherein said fluid precipitation medium is water or ethylene glycol.

5. A process as claimed in claim 1 wherein said crystalline polymer or copolymer is selected from the group consisting of polytrifluorochloroethylene, a copolymer of trifluorochloroethylene and vinylidene fluoride, a copolymer of tetrafluoroethylene and vinylidene fluoride and a copolymer of ethylene and chlorotrifluoroethylene.

6. A process as claimed in claim 3 wherein said crystalline polymer or copolymer is selected from the group consisting of polytrifluorochloroethylene, a copolymer of trifluorochloroethylene and vinylidene fluoride, a copolymer of tetrafluoroethylene and vinylidene fluoride and a copolymer of ethylene and chlorotrifluoroethylene.

* * * * *